US007482521B2

(12) United States Patent
Shrock et al.

(10) Patent No.: US 7,482,521 B2
(45) Date of Patent: Jan. 27, 2009

(54) WATER MUSIC DEVICE

(75) Inventors: Joel Aaron Shrock, Berklely, CA (US); Adam Zev Tobin, Sausalito, CA (US); Matthew Peter de Vito Brown, Berkeley, CA (US); Quillon L. Tsang, Sausalito, CA (US)

(73) Assignee: Panline U.S.A. Inc., Northvale, NJ (US)

( * ) Notice: Subject to any disclaimer, the term of this patent is extended or adjusted under 35 U.S.C. 154(b) by 579 days.

(21) Appl. No.: 10/966,676

(22) Filed: Oct. 14, 2004

(65) Prior Publication Data

US 2005/0160898 A1 Jul. 28, 2005

Related U.S. Application Data

(60) Provisional application No. 60/600,672, filed on Aug. 10, 2004, provisional application No. 60/512,426, filed on Oct. 17, 2003.

(51) Int. Cl.
*G10D 13/02* (2006.01)

(52) U.S. Cl. ..... 84/410

(58) Field of Classification Search ..... 84/402, 84/406, 408, 410, 409
See application file for complete search history.

(56) References Cited

U.S. PATENT DOCUMENTS 4,217,807 A * 8/1980 Nutting et al. ..... 84/402
5,520,089 A * 5/1996 Prentiss ..... 84/330

* cited by examiner

*Primary Examiner*—Kimberly R Lockett
(74) *Attorney, Agent, or Firm*—Gerald T. Bodner

(57) ABSTRACT

A water music device is provided. In one embodiment, the device permits a child to play a song wherein the different tones of the song are generated by tubes filled to different levels using any liquid, such as water. In another embodiment, the water music device may be one or more water drum devices.

9 Claims, 7 Drawing Sheets

WATER MUSIC DEVICE

PRIORITY CLAIMS

This application claims priority under 35 USC 119(e) from U.S. Provisional Patent Application Ser. No. 60/512,426 entitled "Water Music Device" and filed on Oct. 17, 2003 and U.S. Provisional Patent Application Ser. No. 60/600,672 entitled "Water Music Device" and filed on Aug. 10, 2004, both of which are incorporated herein by reference.

FIELD OF THE INVENTION

The invention relates generally to a music generation system and in particular to a device that generates music using water.

BACKGROUND OF THE INVENTION

Various toys exist that permit a child to play in the water, such as bathtub. These toys permit the child to play with the toy, but do not stimulate the creative side of the child brain. It is desirable to provide a toy that permits a child to develop his musical talents/explore his musical talents/creative talents while in the water, such as during a bath. There are no musical instruments designed for making music in a water environment. Thus, it is desirable to provide a water music device and it is to this end that the present invention is directed.

SUMMARY OF THE INVENTION

The water music device permits a child to explore his/her creative side and to try to produce music. The device uses any liquid, such as water, to generate the different tones. In one embodiment of the invention, the device may be one or more tubes wherein each tube is filled to a specified level with liquid so that each different tube generates a different tone. Each different tube may also have a color coded top. The tubes may be provided with sheet music that provides tones to be played by the child using the different tubes wherein the sheet music may identify each tone to be played by the color of its top. The sheet music provided may be on foam/plastic so that it may rest on the liquid, such as the bathwater, or be adhered to the wall of the bathtub. More importantly, water is integral to the sound of the Water Music Toy. A child puts water into the Water music instrument to create specific notes that are attained when the instrument is subsequently played.

In another embodiment of the invention, the device may be a drum device that floats on water and may be made of plastic or resin that is hollow in the bottom. Since the drum is hollow on the bottom, it enables the drum to float on a liquid so long as enough air is retained inside of the interior space in the drum as it is lowered into the liquid. The sound generated by the drum is richer, more resonate when the drum floats on the water (which causes the bottom to be completely sealed) as opposed to being played on a surface that does not create a complete seal. In accordance with a preferred embodiment, the drum may have one or more pontoons that are partially submerged when the drum is placed into the liquid in order to stabilize the drum, i.e. minimize tipping over. The pontoons enhance the ability of the drum to float because they can be made from foam, blow-molded plastic or any other variety of materials that float. Since the drums are hollow in the bottom, they can be tipped over to let air escape thereby changing the height of the surface of the drum relative to the surface of the water. This height adjustment changes the pitch, or tone, of the drums. The drums can be played either with hands, or with drums sticks, mallets or other objects. The drums may be manufactured as one piece or as an assembly of several pieces.

The drum may also have a chamfered rim that enhances structural integrity, and most importantly, minimizes the denting on the top of the drum. The drum may have symbols and other percussion instruments drawn onto/provided on the outside of the drums. In accordance with the invention, the water music device may further include a floating xylophone device. For a water music device with two or more drums, the drums may be free floating or connected together. In accordance with the invention, the water music devices, and in particular the water drums, permit a child to learn basic principles of rhythm and playing drums with easy to follow rhythm charts/sheet music. The sheet music may identify each tone to be played. The sheet music provided may be on foam/plastic so that it may rest on the liquid, such as the bathwater, or be adhered to the wall of the bathtub.

DETAILED DESCRIPTION OF A PREFERRED EMBODIMENT

The invention is particularly applicable to a water music device in which the device utilizes water to generate the different tones of the water music device and it is in this context that the invention will be described. It will be appreciated, however, that the water music device in accordance with the invention has greater utility since tones/beats/music may be generated in other manners that are within the scope of the invention such as other water music devices that generate tones based on a liquid within/surrounding the water music device, such as a water xylophone.

Figure 1:
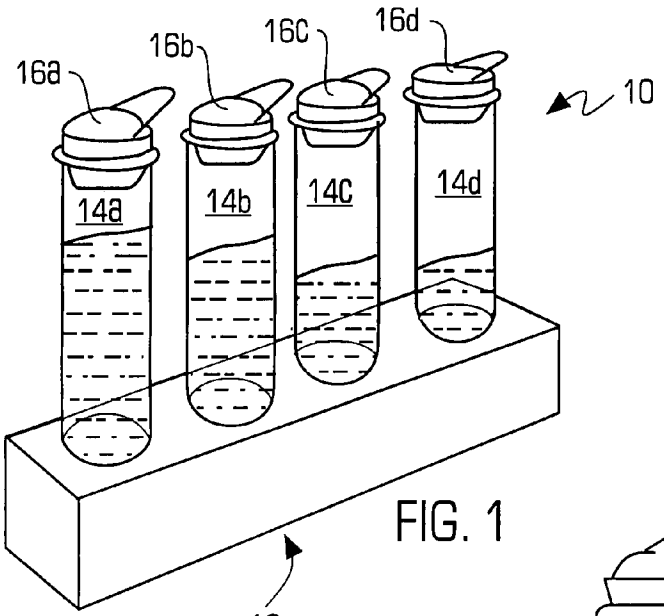
FIG. 1 is an example of a preferred embodiment of the water music device in accordance with the invention.

FIG. 1 is an example of an embodiment of the water music device 10 in accordance with the invention wherein the water music device is a wind instrument in which air is blown into the device to generate a musical tone. The device 10 may include an optional base portion 12 that may hold one or more tubes 14*a-d* as shown. Although four tubes are shown in FIG. 1, the invention is not limited to any particular number of tubes. Furthermore, although cylindrical tubes are shown, the water music device may utilize other shapes and configurations. Each tube 14*a-d* may further include a color coded top portion 16*a-d* that fits onto the top of the tube and permits the user to blow air into the tube and permits air the exit the tube. In accordance with the invention, each tube is filled with a different amount of liquid so that each tube generates a different musical tone. The color coded top portions 16*a-d* permit the user of the device to easily identify each different tube that generates a different musical tone. In accordance with the invention, one or more different pieces of sheet music, such as sheet music for "Old MacDonald", "Mary Had a Little Lamb" or "Twinkle Little Star", may be provided with the device that is printed onto foam so that it can float in the bathtub or be adhered to the bathtub wall. The sheet music may be coded so that each tone to be played to generate the particular piece of music is coded to be the colors on the tops of the tubes so that a child can easily determine the tube to be played that generates the proper tone. The combination of the one or more tubes 14*a-d* as shown permits the user to generate a plurality of different tones that may be used to play music. In this preferred embodiment, each tube may have a uniform diameter. In the alternative, each tube may have a different diameter which would also result in a different tone.

Figure 2:
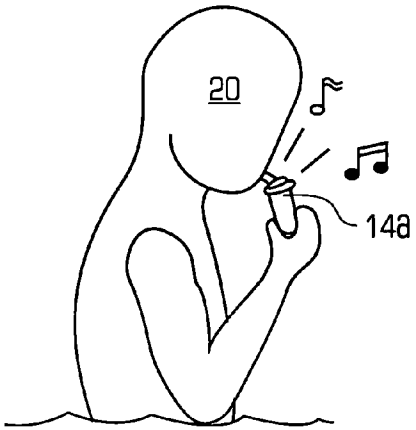
FIG. 2 is a diagram illustrating a user utilizing a tube to generate a particular tone in accordance with the invention.
Figure 3A:
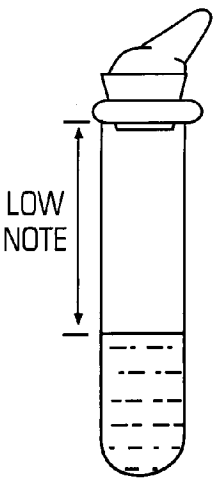
FIGS. 3A and 3B are diagrams illustrating tubes that generate different tones in accordance with the invention.
Figure 3B:
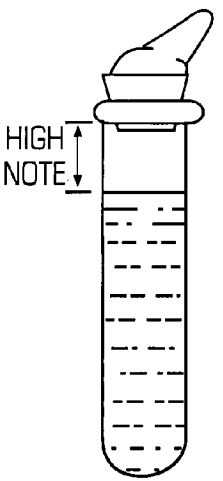

FIG. 2 is a diagram illustrating a user 20 utilizing a tube 14*a* to generate a particular tone in accordance with the invention wherein the user blows into the top portion and a musical tone is generated since the portion of the tube that is not filled with liquid forms a resonating chamber which generates the tone. As is well known, changing the size and volume of the resonating chamber results in a change of the tone being generated as shown in FIGS. 3A and 3B. For example, FIG. 3A illustrates a larger volume of liquid in a tube results in a higher musical note (since the resonating chamber is smaller) whereas FIG. 3B illustrates that a smaller volume of liquid in the tube (a larger resonating chamber) results in a lower musical tone. Now, a preferred embodiment of the tube 14 in accordance with the invention will be described.

Figure 4:
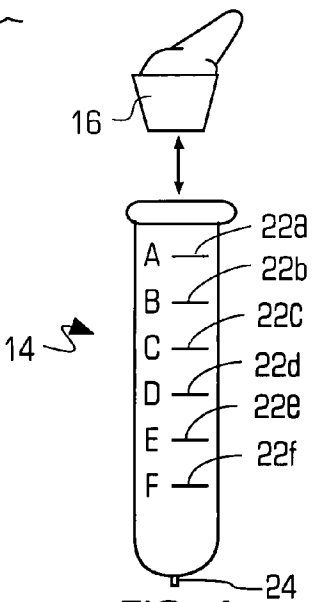
FIG. 4 illustrates a preferred embodiment of each tube of the water music device.

FIG. 4 illustrates a preferred embodiment of each tube 14 of the water music device. Each tube may comprise or more markers 22*a*-22*f* on the side of the tube that mark the levels of liquid to be placed into the tube to generate each musical note, such as "A", "B", "C", "D", "E" and "F". To fill each tube, the top portion 16 is popped off of the tube and liquid is placed into the tube up to the desired level. Each tube 14 may further comprise a valve 24 located at the bottom each of the tube that permits the liquid to be drained out of the tube. The valve may be used to drain the liquid and clean the tube, but it may also be used to drain the liquid out as the user is blowing into the tube which results in a musical note that changes over time as the liquid is drained out of the tube. In a preferred embodiment, each tube may be durable, such as plastic, easy to clean and resistant to mold and bacteria. Now, another embodiment of the water music device in accordance with the invention (a water drum) will be described in more detail.

Figure 5A:
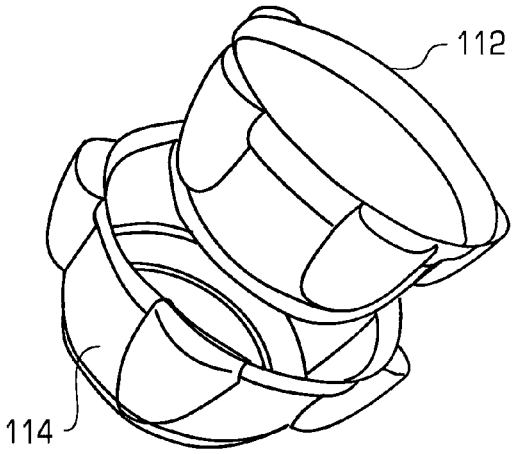
FIGS. 5A-5D are diagrams illustrating a set of water drums in accordance with the invention.
Figure 5B:
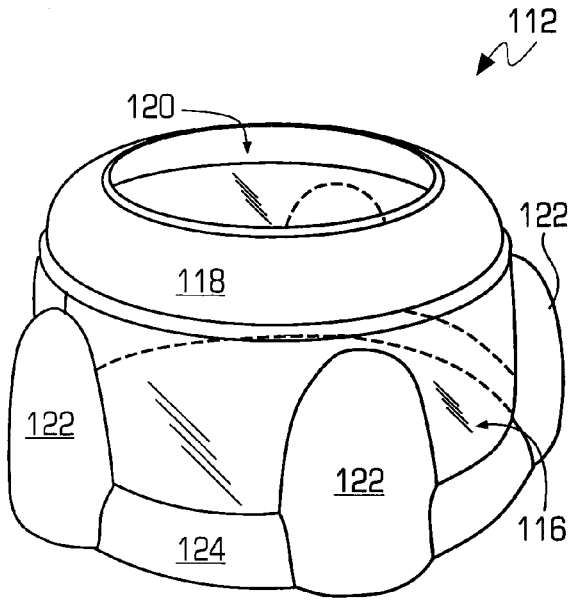
Figure 5C:
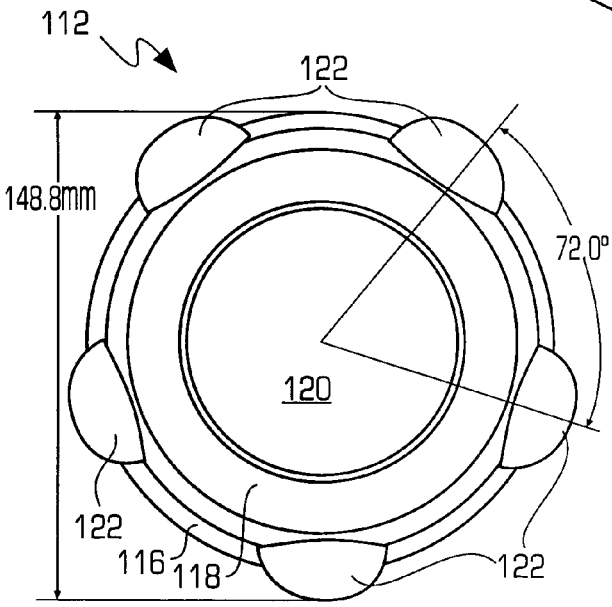
Figure 5D:
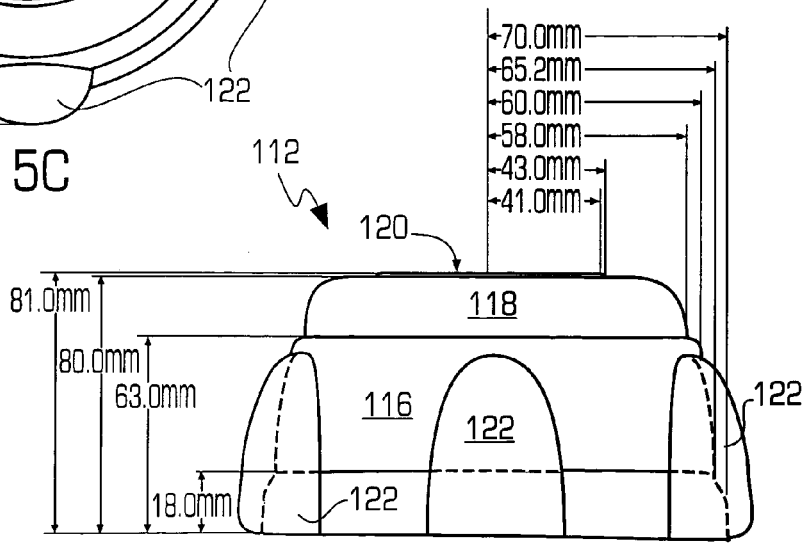

FIGS. 5A-D are diagrams illustrating a set of water drums 110 in accordance with the invention. In this example, the set of water drums may include a small water drum 112 and a larger water drum 114 wherein the small water drum fits into and may be stored within the larger drum. In other embodiments, the set of water drums may have only a single water drum or three or more water drums with different sizes to generate different tones. FIGS. 5B-D illustrate more details of the small water drum 112 wherein FIG. 5B is a perspective view, FIG. 5C is a top view and FIG. 5D is a side view of the small water drum. FIGS. 5C and 5D illustrate the dimensions of the small water drum (in millimeters) for an exemplary small water drum. In accordance with the invention, the small water drum can be of any size and shape.

As shown in FIG. 5B, the small water drum 112 has a generally cylindrical shaped base portion 16 (with a hollow interior) having a rim portion 118 with a surface 120 that may be struck to generate the sound. The base portion 16 may have one or more pontoons 122, attached to the base portion 116, that are made of a material that floats on the water or other liquid. In accordance with the invention, the pontoons are designed so that they are partially submerged (both above and below the liquid line) in order to stabilize the drums, i.e. minimize tipping over. The pontoons enhance the ability of the drums to float because they can be made from foam, blow-molded plastic or any other variety of materials that float. As shown in FIG. 5C, the pontoons 122 may preferably be located at 72° intervals around the periphery of the base portion. The base portion 116 may further include a bottom rim portion 124. In accordance with the invention, one or more different pieces of sheet music, such as sheet music for "Old MacDonald", "Mary Had a Little Lamb" or "Twinkle Little Star", may be provided with the device that is printed onto foam or laminated paper so that it can float in the bathtub or be adhered to the bathtub wall. The sheet music may be coded so that each tone to be played to generate the particular piece of music is coded to the different water drums so that the child can easily determine the water drum to be played that generates the proper tone.

Figure 6A:
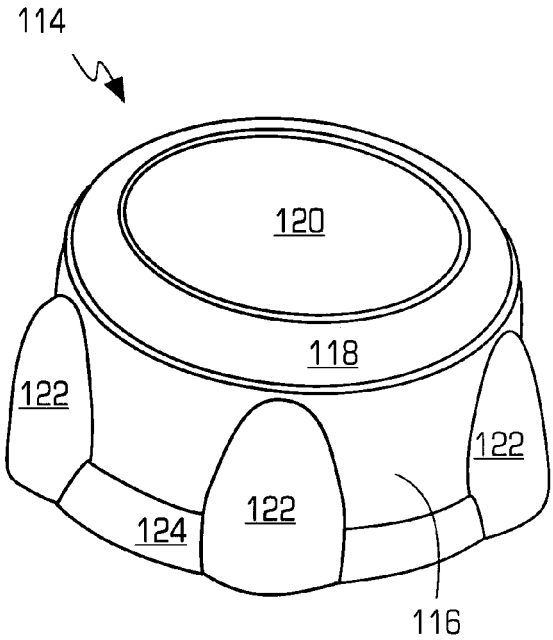
FIGS. 6A-D are diagrams illustrating more details of a water drum in accordance with the invention.
Figure 6B:
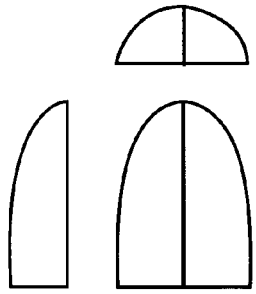
Figure 6C:
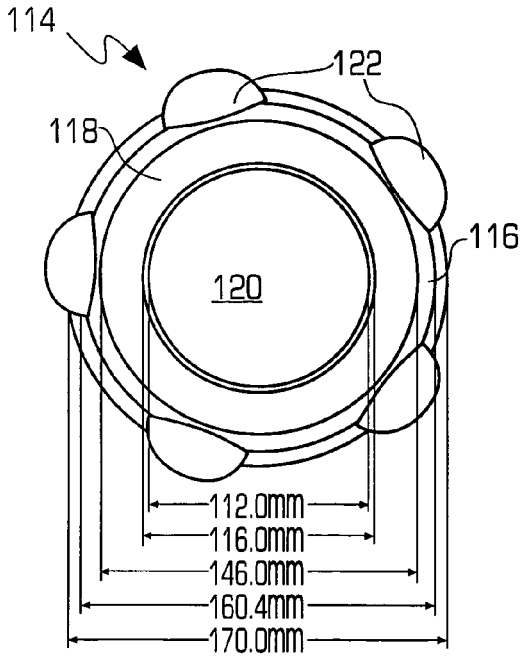
Figure 6D:
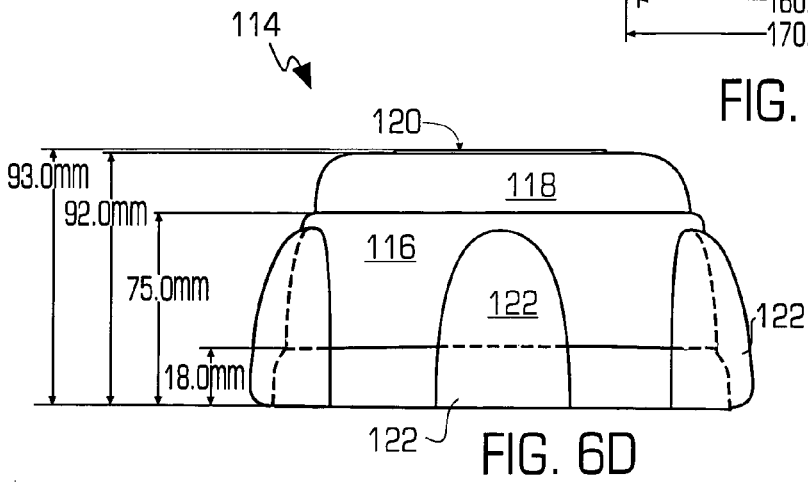

FIGS. 6A-D are diagrams illustrating more details of a water drum 114 in accordance with the invention including a perspective view in FIG. 6A, an exploded view of a platoon in FIG. 6B, a top view shown in FIG. 6C and a side view shown in FIG. 6D. In accordance with the invention, both this drum 114 as well as the drum shown in FIGS. 5A-D may have a hollow interior wherein the base portion 116 may be injection molded or thermoformed. The drums may also be formed as one piece or have tensioned surface 120. FIGS. 6C and 6D illustrate the dimensions of the large water drum (in millimeters) for an exemplary larger water drum. In accordance with the invention, the larger water drum can be of any size and shape. FIG. 6B illustrates the dimensions (in millimeters) of an exemplary pontoon for the larger water drum. The larger drum 114 has the same elements (which are labeled with the same reference numerals) and those elements are not described further herein.

Figure 7:
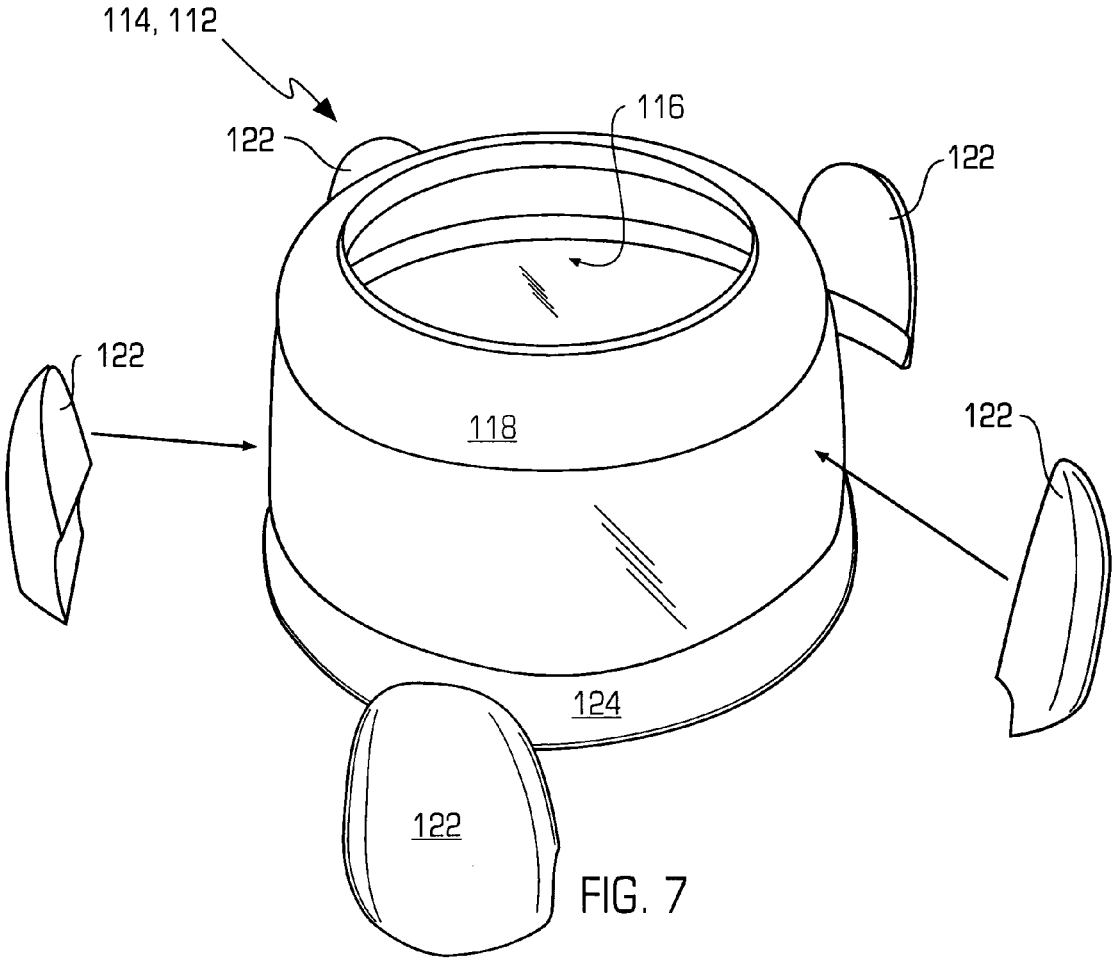
FIG. 7 is an exploded assembly diagram of a water drum in accordance with the invention.

FIG. 7 is an exploded assembly diagram of a preferred embodiment of the water drum 112, 114 in accordance with the invention. The base portion 116 may be made of clear polystyrene or glycol-modified polyethylene terephthalate (PETG), the top rim 118 and bottom rim 124 may be painted and the pontoons 122 (there may be five of the pontoons in a preferred embodiment of the invention) may be made of a painted blow-molded high density polyethylene (HDPE) or cast ethylene vinyl acetate (EVA) foam material.

Figure 8A:
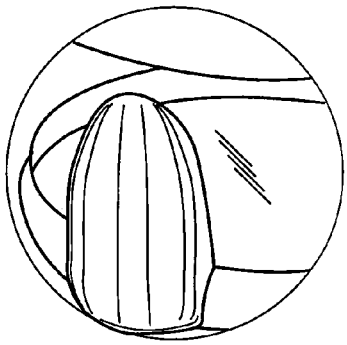
FIGS. 8A-E are diagrams illustrating more details of a pontoon of the water drum.
Figure 8B:
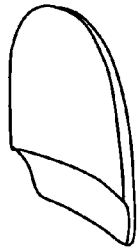
Figure 8C:
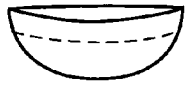
Figure 8D:
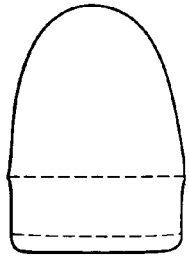
Figure 8E:
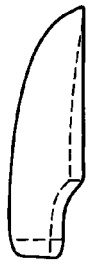
Figure 9:
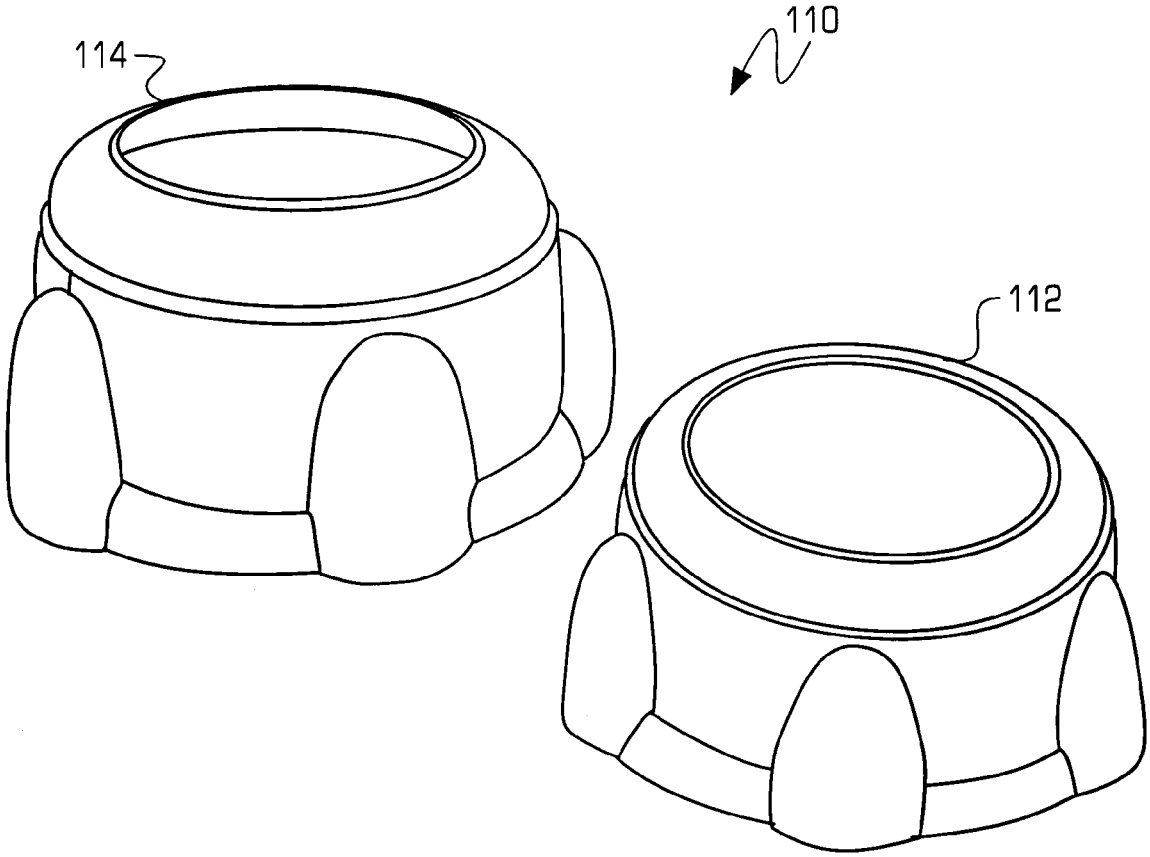
FIG. 9 illustrates a set of water drums in accordance with the invention.

FIGS. 8A-E are diagrams illustrating more details of a pontoon 122 of the small water drum. In particular, FIG. 8A shows the pontoon 122 in perspective view on a water drum, FIG. 8B illustrates a perspective solid model view of the pontoon, FIGS. 8C-E illustrates the dimensions (in millimeters) of an example of the pontoon 122 for a small water drum. In accordance with the invention, the pontoon for the larger water drum will be proportionally larger. FIG. 9 illustrates a set of water drums 110 in accordance with the invention.

Figure 10:
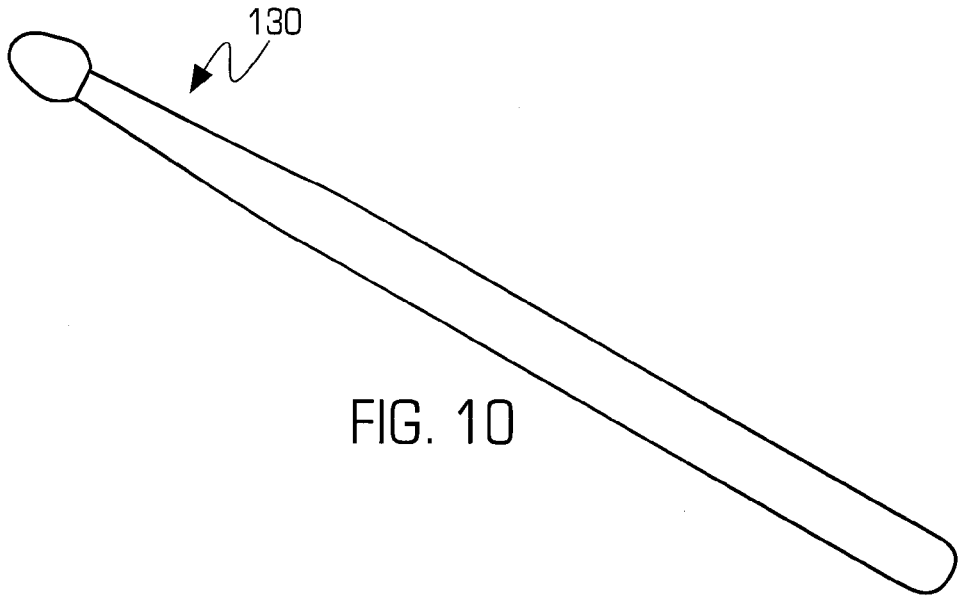
FIG. 10 is a diagram of the drum stick for a water drum in accordance with the invention.

FIG. 10 is a diagram of a drum stick 130 for a water drum in accordance with the invention. The figure shows the dimensions (in millimeters) for an exemplary drum stick that may be used with the water drums. Obviously, the size and shape of the drum stick may be modified and still be within the scope of the invention.

The water drums float on a liquid, such as water, and are partially submerged so that the bottom portion of the drum is underneath the liquid that forms a resonating chamber inside of the drum. Because the drum is hollow on the bottom, it enables the drum to float so long as enough air is retained in the drum as it is lowered into the water. Since the drums are hollow in the bottom, they can be tipped to let air escape, thereby changing the height of the surface of the drum relative to the surface of the water. This height adjustment of the drum relative to the surface of the water changes the pitch, or tone, of the drums. The drums can be played either with your hands, or with drums sticks, mallets or other objects. In accordance with the invention, the top rim may be chamfered to enhance the structural integrity of the drum and, most importantly, minimize the denting on the top of the drums. The drums provide a water music device that has adjustable pitch from a floating drum device. The drums permit a user to learn basic principles of rhythm and playing drums with easy to follow rhythm charts or other song sheets.

In an alternative embodiment, each water drum may have a closed bottom portion and the each water drum may float on the water and generate a different sound due to the different sized cavity inside of each drum. Alternatively, each water drum may have a closed bottom portion with a valve mechanism to permit the user to add water into or remove water from the interior space of the drum in order to change the tone of the drum. As with the other embodiments, the closed bottom drum with the valve also floats on the water.

Figure 11:
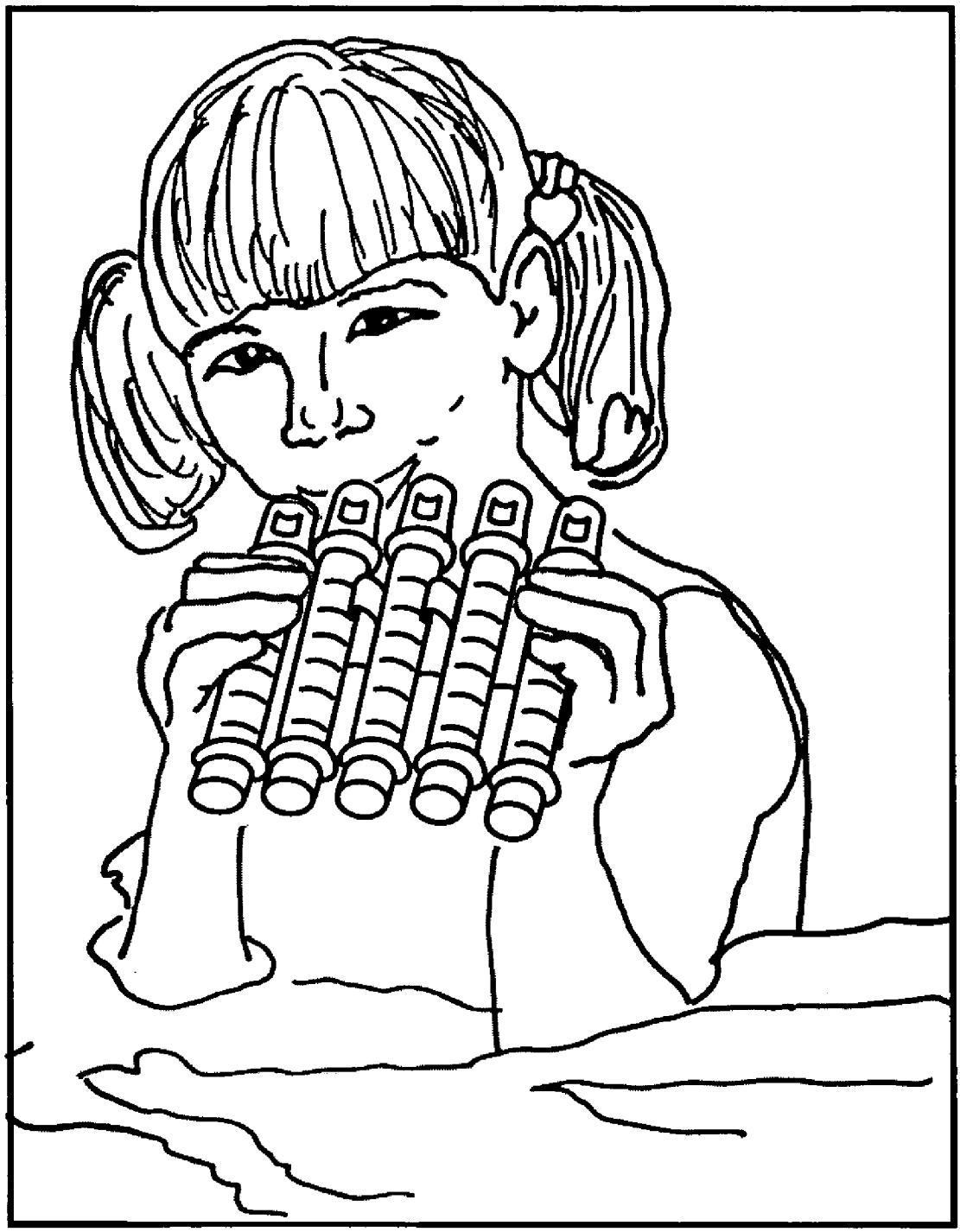
FIG. 11 shows a child making music using the water flute music device in accordance with the invention.
Figure 12:
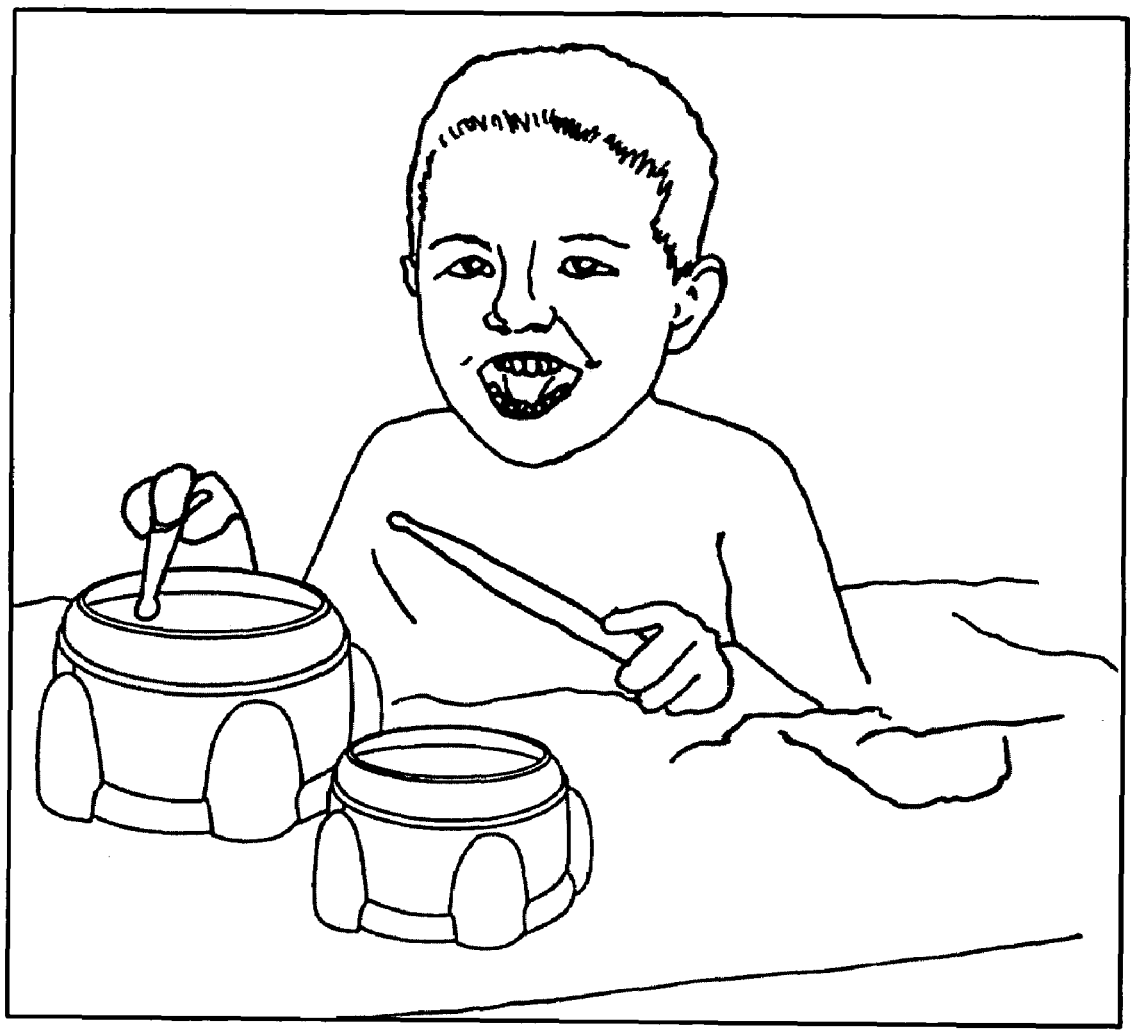
FIG. 12 shows a child making music using the water drum device in accordance with the invention.

FIG. 11 shows a child making music using the water flute music device in accordance with the invention and FIG. 12 shows a child making music using the water drum device in accordance with the invention. As shown in FIG. 11, the water flutes may be connected to each other so that the child may play the water flutes similar to a harmonica with flutes with different tones being adjacent to each other. FIG. 12 shows the embodiment of the water drums in which there may be a large water drum and a smaller water drum. However, the water drum device may also consist of only a single water drum.

While the foregoing has been with reference to a particular embodiment of the invention, it will be appreciated by those skilled in the art that changes in this embodiment may be made without departing from the principles and spirit of the invention as set forth in the appended claims.

The invention claimed is:

1. A water music device that is played by a user, comprising:

an elongated tube having a closed end, an open end situated axially opposite the closed end, and a side wall extending between the closed end and the open end, the side wall, closed end and oven end defining a tube cavity for receiving and holding a volume of liquid, the tube cavity being at least partially fillable by the user with a desired volume of the liquid through the open end thereof; and a top portion having an inlet in communication with the tube cavity which is removably mounted on the open end of the elongated tube and which permits the user to blow air into the tube and permits air to exit the tube;

wherein air blown into the cavity of the tube through the inlet of the removable top portion causes the water music device to generate a musical tone, the musical tone generated by the water music device varying in response to the desired volume of liquid received by the cavity of the elongated tube.

2. The device of claim 1, which further comprises a valve affixed to the closed end of the elongated tube and being in communication with the tube cavity, the valve being one of a closed state to prevent liquid contained in the tube cavity from passing therethrough and out of the tube cavity, and an open state to allow liquid contained in the tube cavity to pass therethrough and out of the tube cavity.

3. The device of claim 1, wherein the tube further comprises one or more indicators situated on the side wall of the tube wherein each indicator indicates a level of liquid associated with a predetermined tone to be generated by the tube.

4. A water flute device, comprising:

a set of one or more water music devices as defined by claim 1, the water music devices having respective elongated tubes into which an amount of liquid may be introduced; and wherein a different amount of liquid is introduced into each tube of the one or more water music devices to generate a different tone when air is blown into the tube of the one or more water music devices.

5. The water flute device of claim 4, wherein each tube of the one or more water music devices of the water flute device further comprises one or more indicators on the side wall of the tube wherein each indicator indicates a level of liquid associated with a predetermined tone to be generated by the tube.

6. The water flute device of claim 4, wherein the one or more water music devices of the water flute device have different colors to indicate different tones being generated by the one or more water music devices of the water flute device.

7. The water flute device of claim 6, wherein the, one or more water music devices of the water flute device include a color, end wherein the water flute device further comprises a piece of music having notes wherein each note in the piece of music is color coded to match the color of the one or more water music devices.

8. The water flute device of claim 4 further comprising a stand into which the set of one or more water music devices is placed for storage.

9. The water flute device of claim 4 wherein the one or more waiter music devices of the set are connected to each other.

* * * * *